US007406808B1

(12) United States Patent
Martin

(10) Patent No.: US 7,406,808 B1
(45) **Date of Patent: *Aug. 5, 2008**

(54) LIFTER RING ROTATION CONTROL APPARATUS

(76) Inventor: Wendell S. Martin, P.O. Box 145, FS, AR (US) 72902

( * ) Notice: Subject to any disclaimer, the term of this patent is extended or adjusted under 35 U.S.C. 154(b) by 15 days.

This patent is subject to a terminal disclaimer.

(21) Appl. No.: 11/273,578

(22) Filed: Nov. 14, 2005

(51) Int. Cl.
*B65B 7/28* (2006.01)
*B67B 3/20* (2006.01)

(52) U.S. Cl. ..... 53/317; 53/318; 53/331.5

(58) Field of Classification Search ..... 53/484, 53/485, 490, 300, 317, 318, 331.5
See application file for complete search history.

(56) References Cited

U.S. PATENT DOCUMENTS 4,295,320 A 10/1981 Willingham ..... 53/201
4,658,565 A 4/1987 Westbrook et al. ..... 53/308
4,939,890 A * 7/1990 Peronek et al. ..... 53/486
5,826,400 A * 10/1998 Martin et al. ..... 53/367

* cited by examiner

*Primary Examiner*—Rinaldi Rada
*Assistant Examiner*—John Paradiso
(74) *Attorney, Agent, or Firm*—Keisling Pieper & Scott PLC; David B. Pieper; Trent C. Keisling

(57) ABSTRACT

The use of a frictional engagement with the top and/or side of a lifter ring on the neck of a bottle for controlling the rotation of the bottle during the capping process. The frictional engagement may be used to hold the bottle steady during the capping process or may be utilized to cause counter rotation of the bottle during the capping process. A method and apparatus for using counter rotation of the bottle to apply a cap to a bottle is also described.

6 Claims, 15 Drawing Sheets

[DETAIL A]

[DETAIL B]

[DETAIL C]

[DETAIL D]

LIFTER RING ROTATION CONTROL APPARATUS

CROSS-REFERENCE TO RELATED APPLICATIONS

This application claims benefit of co-pending U.S. patent application Ser. No. 10/773,063 filed Feb. 4, 2004, entitled "LIFTER RING ROTATION CONTROL" that claims benefit of U.S. Provisional Patent Application Ser. No. 60/445,032 filed Feb. 4, 2003, entitled "LIFTER RING ROTATION CONTROL."

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to improvements in bottle capping machines or bottle filling and capping machines to improve the efficiency and reliability of handling plastic bottles which have become a very common container for beverages and, to some extent, other liquids. More particularly, the invention relates to improvements particularly suited for plastic bottles with a lifter ring on the neck of the bottle and pre-threaded screw caps. As shown in FIG. 1 of the drawings, the lifter ring 12 is shown as the peripheral lip immediately below the threads 14 at the cap position on the bottle 10.

2. Description of the Known Art

In processing screw cap threaded containers through a known type of filling and/or capping machine (such as shown, for example, in U.S. Pat. No. 4,295,320 or U.S. Pat. No. 4,658,565, both patents hereby expressly incorporated by reference), it has been found to be necessary to prevent the spinning capping head that applies the screw cap from also rapidly spinning the bottle; such spinning of the bottle can have a very deleterious effect on the operation of the machine as the bottles pass through at a high rate of speed, often 100 bottles per minute or more. Various expedients have been employed to prevent spinning of the bottle as the screw cap is rotated on the threaded bottle neck and firmly seated with a desired torque. A very common expedient has been to provide knife elements or pin elements which penetrate the bottom edge of the lifter ring of the plastic bottle. While the reliability of such a technique is less than desirable and has the disadvantage that it inevitably leaves a mark on the bottle, it has been accepted in the industry.

U.S. Pat. No. 5,826,400, issued to Martin et al. on Oct. 27, 1998 discloses a plastic bottle spinning restraint for a capping machine which is also hereby incorporated by reference in its entirety. This patent application is directed to a method for holding the petaloid shape at the bottom of a bottle to be capped so that the bottle will not spin during the capping procedure. Modifications in the amount of plastic utilized by the bottling companies has affected the ability of the bottle to support itself to allow this machine to properly restrain the bottle during the capping procedure. Therefore, a new method for holding the bottle during the capping procedure is needed.

Referring to FIG. 1, it will be noted that bottle capping machine environment is shown representing a typical bottling machine employed for capping (or filling and capping) petaloid plastic bottles which uses a rotational movement f the bottle under a spinning capping head that is concurrently rotated. While the bottom shape for holding a plastic bottle is shown, the knife apparatus for engaging the cap ring on the neck of the bottle to prevent rotation (as in U.S. Pat. No. 4,658,565) is not shown. Such previously known apparatus should in any event be disabled or removed from the apparatus in order to employ Applicants' invention. The advantages of removing or disabling the apparatus employing bottle-piercing knives which catch and engage the bottle under the neck ring can better be understood by a brief description of such apparatus and its function. For the knife type apparatus, a substantial amount of downward pressure on the top of the bottle, e.g. 20-50 pounds, is necessary to force the underneath side of the bottle neck ring into the pins or knives to prevent rotation of the bottle. This downward force must be induced through the closure threads to the bottle threads, and this method has two detrimental effects. First, the friction resulting from the thread to thread contact creates a variance in the application torque. The application torque being the summation of the sealing friction and thread friction. Secondly, the knives can create a sharp burr on the edge of the neck ring because of their necessary indentation in the plastic. If the knife edges are not in excellent condition, they will peel the plastic from underneath the neck ring which results in the accumulation of undesirable shavings around the area of the capping operation. Often the knife edges will produce a sharp bur under the neck ring which can cause injury to the consumer of the product when the closure is removed. Even a slight injury which breaks the skin of the consumer is of potential concern.

The rotation restraint system shown in FIG. 1 is simple and usable on virtually all strong plastic bottles which have petaloid bases. A reduction in the amount of plastic in the bottles has made this system unusable for new lower material bottle designs. However, this does provide a good basis for understanding the environment for the present invention. As seen in FIG. 1, the major feature of the prior art is the provision of a rotational base plate 20 having plurality of sets of fingers 22 in a petaloid configuration arranged in a nest residing below the primary surface 24 of table 26 and configured to accept the bottom 16 of the particular size and shape of petaloid bottle being processed. It should be noted that as to most of the elements and parts of a capping machine (excluding the previous form of bottle anti-rotation device) their function and, in most cases, their structure will not be changed. Elements retaining their usual function include rotating center unit 30, upper stationary guide 40, lower stationary guide 50, upper rotating receiver 60, and mid-level rotating receiver 70. It will be appreciated that the particular configuration of these elements will change if, and when, there is any significant change in the size or shape of the bottle being processed. In FIG. 1, the apparatus required to transport bottles to and convey bottles away from table 26 has been omitted in order to better show important features. Also much of the capping and/or filling structure and the cap supply means has been omitted. Although capping machines are known in which the table, such as table 26, turns in a counterclockwise direction, table 26 in FIG. 1 and the other rotating elements moving therewith turn in a clockwise or leftward direction as indicated by arrow 31. Each bottle, such as uncapped bottle 18, is first positioned by a star wheel or other conveyor mechanism and received in recess 21 of rotating receiver 20 and is guided and maintained in vertical position by recesses 62 and 72. In FIG. 1, bottle 17 is shown at or near the exit position from table 26 and cap 15 would be seated on bottle 17 with a torque determined by the slip clutch of a spinning capping head 80 shown in dashed lines with a spin rotational direction shown by arrow 81. Bottles exit from the capping machine by virtue of an exit star wheel or other means receiving the bottles from the rotating table, such as table 26, and delivering them to a conveyor, in a manner which is generally the reverse of their mode of entry (e.g. by an entry star wheel operation which delivers from conveyor to rotating table).

Thus, it may be seen that these prior art patents are very limited in their teaching and utilization, and an improved lifter ring rotation control is needed to overcome these limitations.

SUMMARY OF THE INVENTION

The present invention is directed to a spin control guide which contacts the lifter ring on a bottle in order to control the movement of the bottle during the capping process. The present invention utilizes the spin control guide to control bottle movement. In the preferred embodiment, this is done by contacting at least one of the upper or side surfaces of the lifter ring in order to position and control the spin of the bottle during the capping procedure. In the preferred embodiment the lower surface of the ring is used to support the bottle. The preferred embodiment shows the controlling guide implemented as a groove with both a top and a side, although the use of a bottom support in the groove with only a rubber side surface contacting element has also been utilized and proven to be effective. Alternative constructions using moving pieces on the bottom support surface have also been considered.

Several of the advantages of the present invention incorporate the utilization of a controlling groove to contact either or both of the upper surface and side surface of the lifter ring in order to control bottle rotation to either prevent spin or provide a reverse spin of the bottle during the capping process. A unique aspect of the present invention is the use of the retaining groove to contact and control the outer surface or side surface of the lifter ring in order to control bottle spin. Another unique aspect of the present invention is the use of the retaining groove to contact and control the upper surface or top surface of the lifter ring in order to control bottle spin. A still further unique aspect of the present invention is the utilization of a thin upper surface for contacting the upper surface of the lifter ring in order while still allowing for the tight clearance and deformation of the cap upon installation onto the bottle.

Yet a further advantage of the present invention is the ability to fix the spin the bottle in relation to the capping head in order to allow a more efficient installation of a cap. The present invention also provides an apparatus and method for reverse spinning the bottle against the rotation of the cap to increase the efficiency of the cap installation.

The present invention provides yet a further advantage in teaching that the bottle itself may be spun in order to provide all of the spin necessary for the threaded installation of the cap. Thus, the spin of the bottle allows for the cap to be held still and eliminates the requirement for a separate cap spinning motion that requires an upper rotational assembly for installing the cap. This greatly simplifies the capping machine.

Yet a further advantage of the present invention is found in another alternative method for control of the bottle position utilizing a holding groove and a slide groove in order to control bottle position during the installation of the cap.

A still further method of improvement is the reverse spin of the bottle during the installation of the cap.

An additional method of improvement is the spin of the bottle during the installation of the cap without the spin of the cap as a method for installing the cap onto the bottle.

Other advantages of the present invention include the control of the alignment groove by using either a fixed position plate controlling the groove position or using a biasing spring or positioning spring to control the plate operation.

One of the unique aspects of the present invention provides the ability to use the controlling groove as either a capturing wedge or a sliding wedge.

A still further advantage of the present invention is the installation of the groove on either the outside fixed position or internal rotational position for controlling the movement of the bottle.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
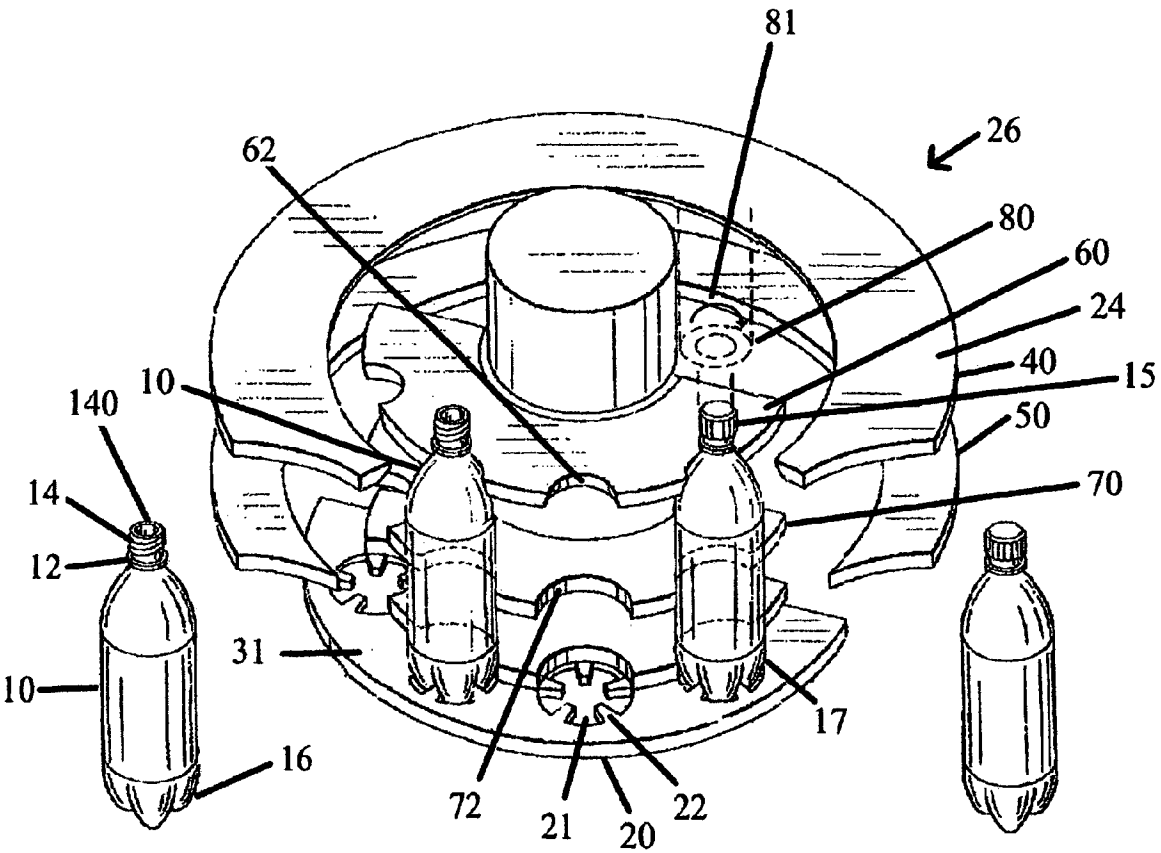
FIG. 1 is a prior art assembly showing a perspective, partially schematic, view of plastic bottle rotation restraint apparatus with a portion of a typical capping machine environment with which it interacts.
Figure 2:
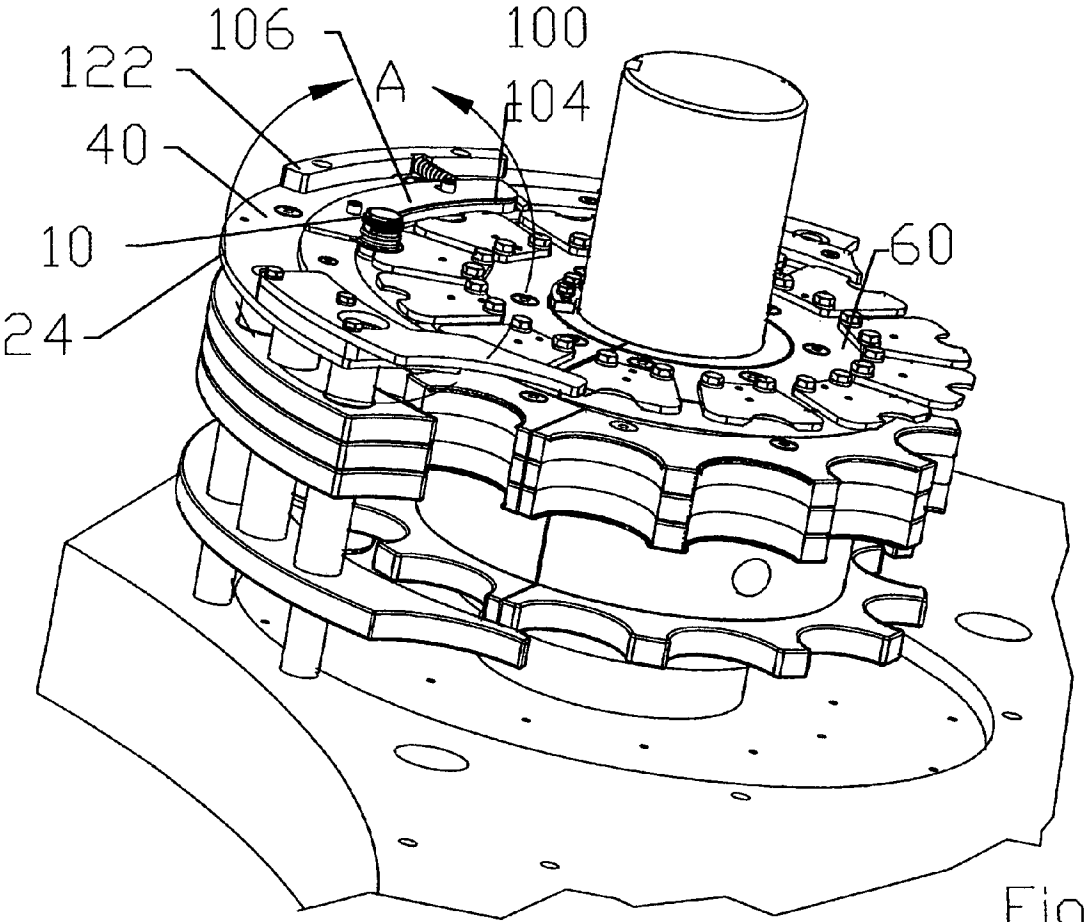
FIG. 2 is a left side perspective view of the lifter ring rotation control assembly of the present invention using a spring biased guide plate.

The present embodiment relies on the utilization of the cast top 140 currently utilized in manufacturing the plastic bottles 10 commonly used for soda pop. This cast top 140 is provided with good tolerance that allows for a tight fit against the threads 14 of the cap 15 as well as providing for a control mechanism for controlling the spin or rotation of the bottle 10 during the capping process. Previous embodiments have problems utilizing the knives against the lower surface of the lifter ring 12 in order to control the spin of the bottle 10 during its travel through the capping machine. In contrast to the prior arts' utilization of these knives, the present invention utilizes two different embodiments to provide either fixed position or counter spin.

As shown in the drawings, the first preferred embodiment of the present invention utilizes a spin control guide 100 substituted into the known prior art capping equipment. The spin control guide 100 may be constructed as two different plates with one plate mounted to the top of the upper stationary guide 40 and the other plate mounted to the top of the upper rotational guide 60. In the preferred embodiment shown in FIGS. 2, 3, 6, and 7, the invention is implemented as a controlling groove 104 machined into the edge of a spin control plate 106 attached to the top of the upper stationary guide 40. A supporting slide plate 108 is then provided that is manufactured either as a part of, or as a separate item mounted on top of, the upper rotational guide 60. these plates 106, 108 support the bottle and control the bottle spin during the rotation of the bottle through the capping station.

Figure 19:
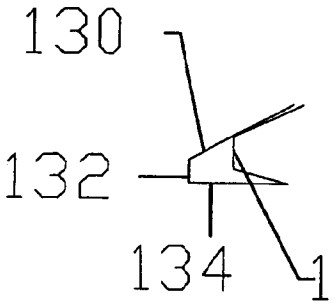
FIG. 19 shows a wedge shape for the groove contacting the upper surface of the lifter ring.
Figure 20:
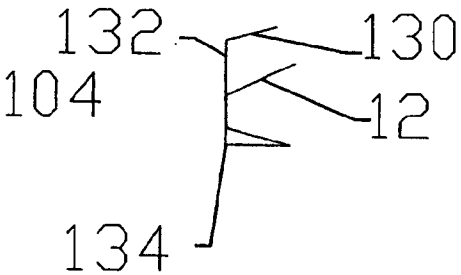
FIG. 20 shows a wedge shape for the groove contacting a side surface of the lifter ring.
Figure 21:
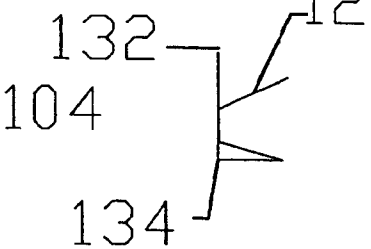
FIG. 21 shows an L-shape for the groove contacting the side surface of the lifter ring.
Figure 22:
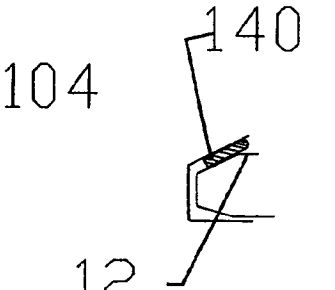
FIG. 22 shows a wedge shape for the groove using an elastic material contacting the upper surface of the lifter ring.
Figure 23:
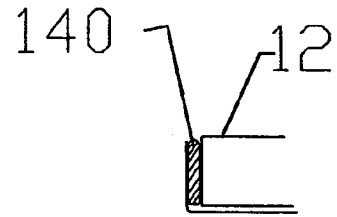
FIG. 23 shows an L-shape groove using an elastic material contacting the side surface of the lifter ring.

As noted by the drawings, the frictional capturing wedge may be constructed with the upper surface 130 and lower surface 134 having a sufficient angled relation in order to frictionally contact the top surface of the lifter ring 12. No previous devices known to have utilized an upper plate with a capturing wedge for contacting the upper surface 130 of the lifter ring 12. Alternative groove constructions are shown in FIGS. 19, 20, and 21 which show that the groove may be manufactured with only a lower surface 134 and a side surface 132 such that the capturing groove 104 contacts the side 126 of the lifter ring 12. A still further alternative embodiment for the groove is shown in FIGS. 22 and 23 which uses an elastic frictionally engaging material 140, the one used was a rubber gasket, placed to contact either or both of the side 126 and/or upper surface 124 of the lifter ring 12. This rubber type of material was placed into the wedge to test these embodiment and successful trials were obtained. From this, other alternative may be considered with variation of the engagement an use of frictionally an/or elastic materials at the lower 128, side 126, and upper surfaces 124 of the groove 104. Thus, the present invention is not meant to be limited to the particular configuration described herein, but is to be understood to teach the frictional engagement of the lifter ring for controlling bottle rotation in a reverse rotation 105 to the direction of the capping head 80 and is specifically directed to engagement of the top and/or side of the lifter ring. As an alternative construction, a second embodiment is also provided such that it is understood that the roles of the spin and slide plates discussed in this invention could be reversed as a different method for implementing this invention such that the bottle would be in a fixed relationship to the rotational position of the spinning capping head 80.

As shown in the drawings, the preferred embodiment uses a spin control plate 106 that is attached to the top of the upper stationary guide 40. The lifter ring 12 of the bottle 10 fits inside the groove 104 on the spin control plate 106 during the bottle 10 rotation through the capping machine. In this preferred embodiment, a frictional engagement between the lifter ring 12 and the groove 104 may be used to cause a spin of the bottle in a direction that is counter to the direction of rotation of the bottle 10 through the capping station. A second embodiment will be discussed in which the lifter ring 12 can slide inside the groove 104 on the spin control plate 106 and be fixed by a frictional groove 104 on the rotating hold plate 110 to provide a fixed type of bottle control. Thus, it is to be understood that the groove 104 can be implemented as either a sliding groove or a friction groove on either the stationary or rotating plate. Because one plate is fixed and the opposite plate rotates, the opposite type of groove 104 is to be used on the opposing plate. Using this technique, either counter rotational spin or no spin may be imparted in accordance with the placement of the frictional groove and the sliding groove. If a frictional groove 104 is used on the upper stationary guide 40 then a sliding groove or sliding support is used on the upper rotational guide 60. In the preferred embodiment that is shown, sufficient rotation is achieved with the engagement of the side of the lifter ring 12 with the spin control plate 106 such that a spinning turret head is not needed and a fixed turret head may be used on the capping machine. This eliminate one of the major sources of problems in the bottle capping area of the art.

In the first preferred embodiment, a frictional engagement is provided against the lifter ring 12 of the bottle 10 using the wedge groove 104 in the spin control plate 106 mounted on top of the upper stationary guide 40. In this preferred embodiment, the friction is great enough such that the bottom of lifter ring 12 is merely slidingly supported on the upper rotational guide 60 such that the side and upper portions of the sliding groove on upper rotational guide 60 has been eliminated as a cost saving feature. In this manner, a sliding engagement is provided between the bottom of the lifter ring and supporting slid plate 108 on the upper rotatatable receiver 60. The bottle 10 will spin in the semi-circular aperture 109 of the supporting slid plate 108 on the rotatatable receiver 60 as it frictionally engages the lifter ring 12 against the spin control plate 106 mounted on top of the upper stationary guide 40. In this embodiment the bottle 10 will counter-rotate in relation to the upper rotatable receiver 60 such that the bottle 10 rotation may be utilized for mounting the cap 15 to the upper portion of the bottle 10. Control for the pressure exerted by the spin control plate 106 may be provided with a spring 118 as a biasing mechanism or by a fixed location mounting of the spin control plate 106 in the capping machine.

Figure 3:
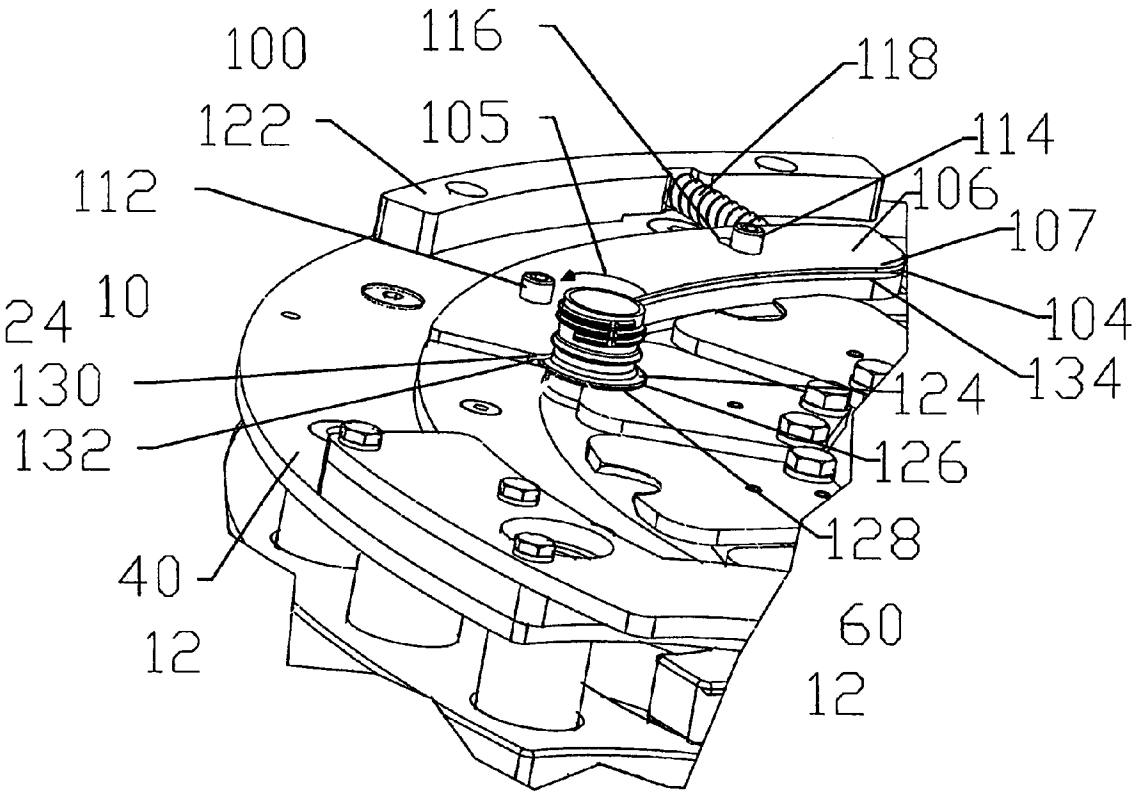
FIG. 3 is a magnified view of section A-A of the embodiment of FIG. 2.

FIG. 3 shows how the spin control plate 106 is mounted with a first set screw 112 and a second set screw 114. The first set screw 112 is used as a pivot pin and the second set screw 114 is left slightly distal from the surface of the spin control plate 106 such that the shaft of the second set screw 114 provides a movement control pin. The second set screw 114 is contained within an arcing movement slot 116 within the spin control plate 106. In this manner, a biasing spring 118 positioned between a control block 122 and the spin control plate 106. This biasing spring 118 may be utilized to press the spin control plate 106 and specifically, the alignment groove 104 against the lifter ring 12 at the top of the bottle 10.

FIG. 3 of the drawings shows detail about how the alignment groove 104 is constructed in the spin control plate 106 of the assembly 100. The spin control plate 106 is currently being manufactured as a solid plate with a groove 104 cut into the side of it or as three separate plates which are stacked on top of each other with the upper and lower plates extending out from the middle plate to form the wedge or groove 104 of the present invention. As also shown in FIGS. 19-23, the alignment groove 104 includes a groove upper inside surface 130, groove side inside surface 132, and groove lower inside surface 134. The lifter ring 12 includes lifter ring upper surface 124, lifter ring side surface 126, and lifter ring lower surface 128. As may be seen at the end view of the spin control plate 106, at the point of contact with the lifter ring 12 the upper surface 124 of the lifter ring 12 is contacting the upper inside surface 130. In this manner, a frictional engagement is made with the lifter ring. For this frictional design, the alignment groove 104 is constructed as a containment wedge 136 to enhance the frictional engagement with the lifter ring. Remember that the upper rotating receiver 60 in this embodiment provides a sliding bearing surface on which the bottom side 128 of the lifter ring 12 rests. Because the ring upper surface 124, or as an alternative the ring side surface 126, has a frictional engagement with the spin control plate 106, the rotation of the upper rotating receiver 60 will cause the bottle to spin in a direction opposite to the rotation. This is caused by the frictional engagement of the lifter ring 12 with the containment wedge 136 and the rotation of the upper rotating receiver 60 in comparison with the upper stationary guide 106. The frictional engagement of the lifter ring 12 of the upper portion of the bottle 10 against the spin control plate 106 mounted on the upper stationary guide 40 allows for the bottle 10 to spin in a counter-rotating direction with a sliding engagement of the lifter ring bottom 128 against the upper rotating receiver 60. Thus, a reverse rotation or spin of the bottle 10 is induced with this simple configuration.

Figure 6:
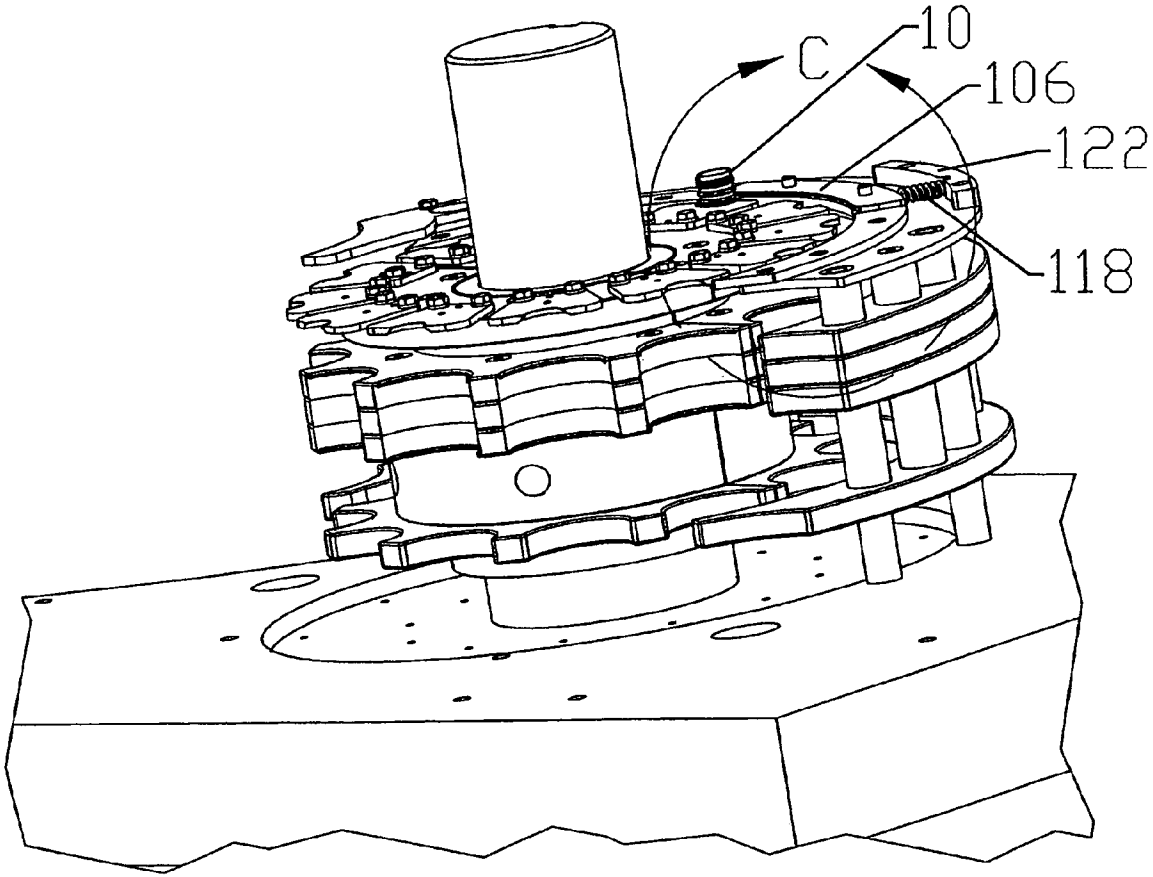
FIG. 6 is a right side perspective view of the lifter ring rotation control assembly of the present invention using a spring biased guide plate.
Figure 7:
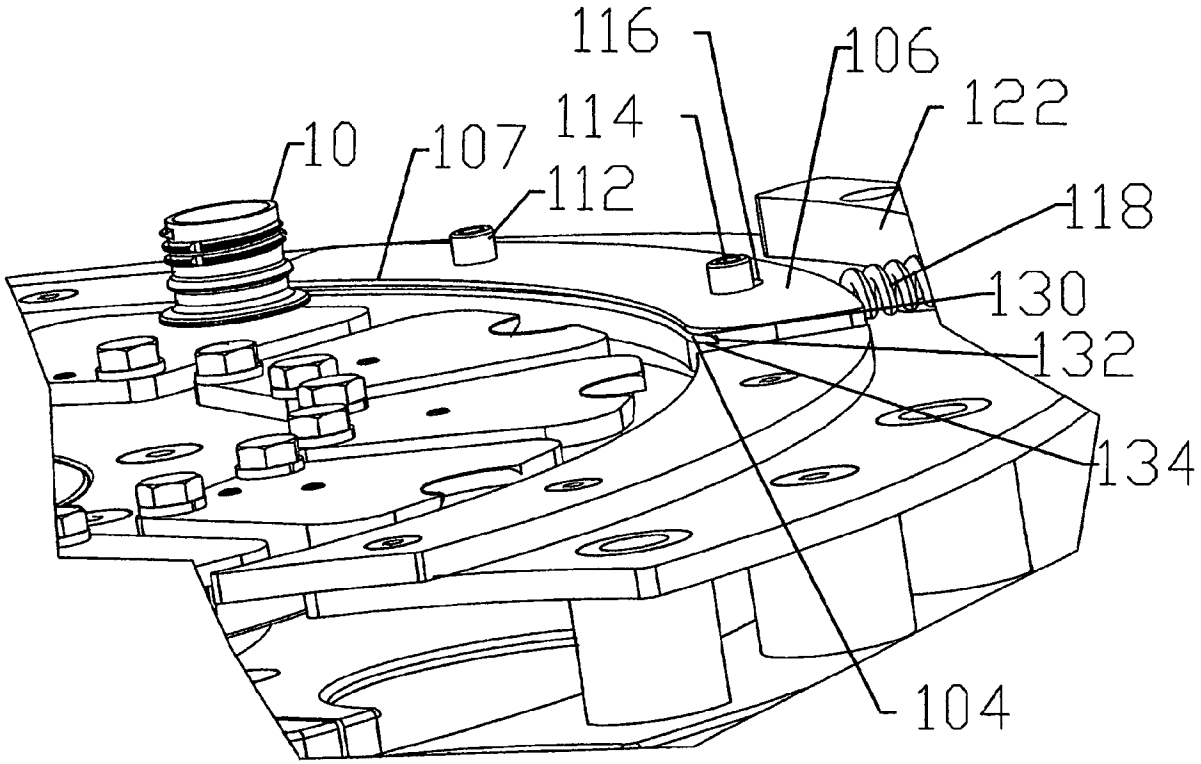
FIG. 7 is a magnified view of section B-B of the embodiment of FIG. 6.
Figure 10:
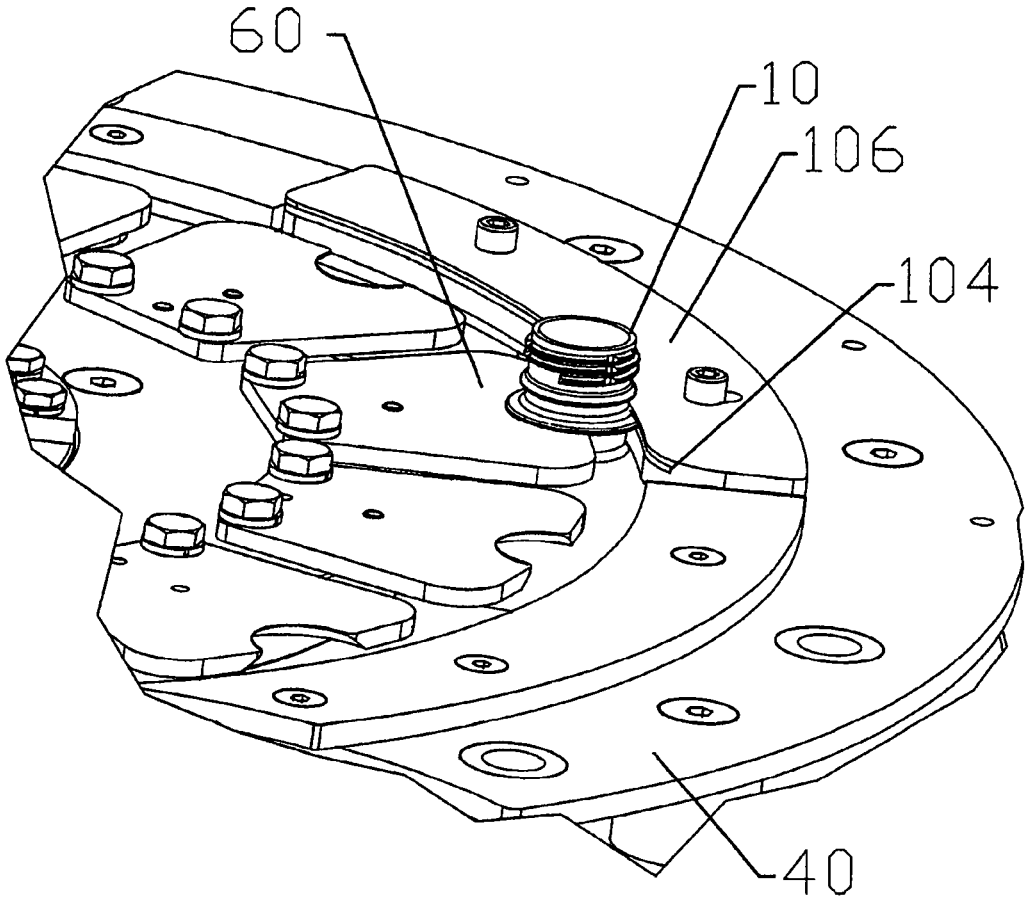
FIG. 10 is a magnified view of section B-B of the embodiment of FIG. 8 after continued rotation of the inner support and the frictional engagement with the guide plate has caused a full rotation of the bottle.
Figure 11:
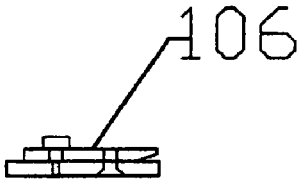
FIG. 11 shows a left side view of the plates used to form the groove including a bottle neck shaped indention for use on the upper rotational guide.
Figure 12:
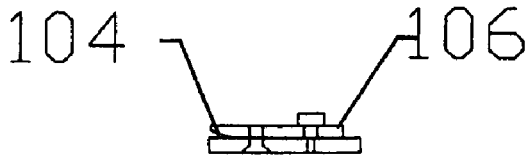
FIG. 12 shows a right side view of the plates used to form the groove including a bottle neck shaped indention for use on the upper rotational guide.
Figure 13:
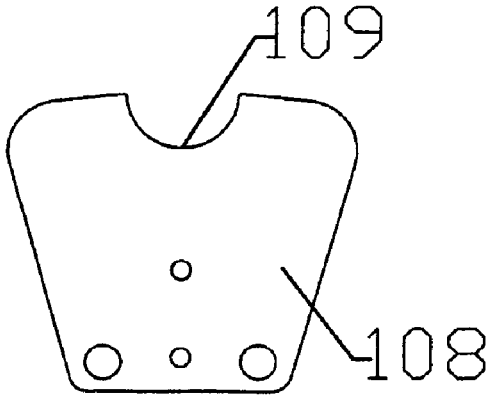
FIG. 13 shows a bottom view of the plates used to form the groove including a bottle neck shaped indention for use on the upper rotational guide.
Figure 14:
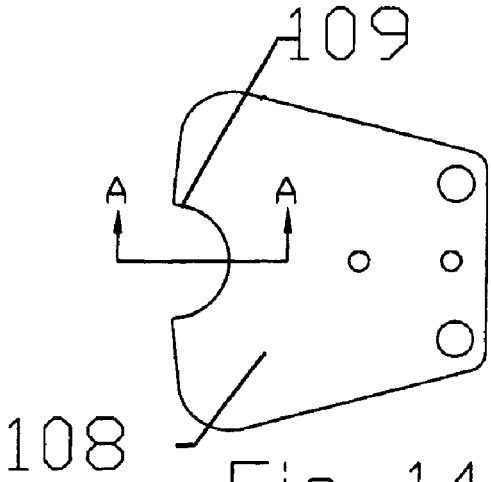
FIG. 14 shows a top view of the plates used to form the groove including a bottle neck shaped indention for use on the upper rotational guide.
Figure 15:
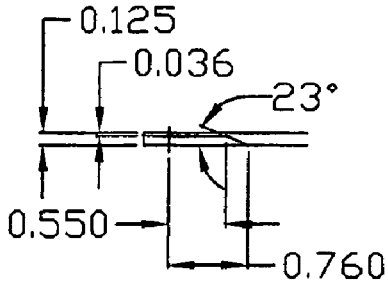
FIG. 15 shows a left side view of the angled upper plate used to form the groove.

Alternatively, the unit may be constructed so as to place the frictional style of groove 104 in an upper plate mounted to the top of the upper rotating receiver 60 and provide a lower bearing or slide surface on top of the upper stationary guide 106 such that the bottle 10 does not rotate as it travels through the capping machine. FIGS. 6 and 7 of the drawings provide a back view of the mounting of the spring biased version of the spin control plate 106 on top of the upper stationary guide 40 and show an exiting lower slide plate 138 providing for the exiting of the bottle 10 from the capping machine. FIG. 10 of the drawings shows the utilization of the wedge groove 104 in the spin control plate 106 as the bottle 10 is further rotated into the capping machine such that the wedge groove 104 may control the position or rotation of the bottle 10 while it travels through the capping machine.

Figure 4:
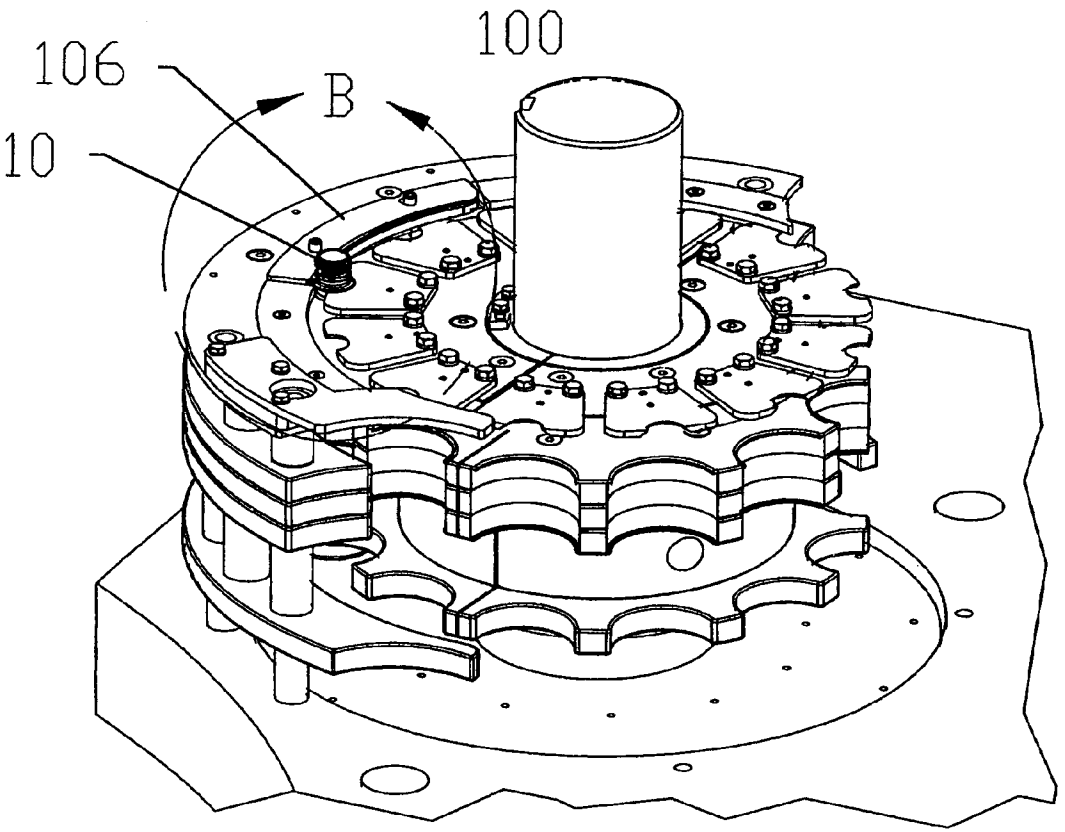
FIG. 4 is a left side perspective view of the lifter ring rotation control assembly of the present invention using a fixed position guide plate.
Figure 5:
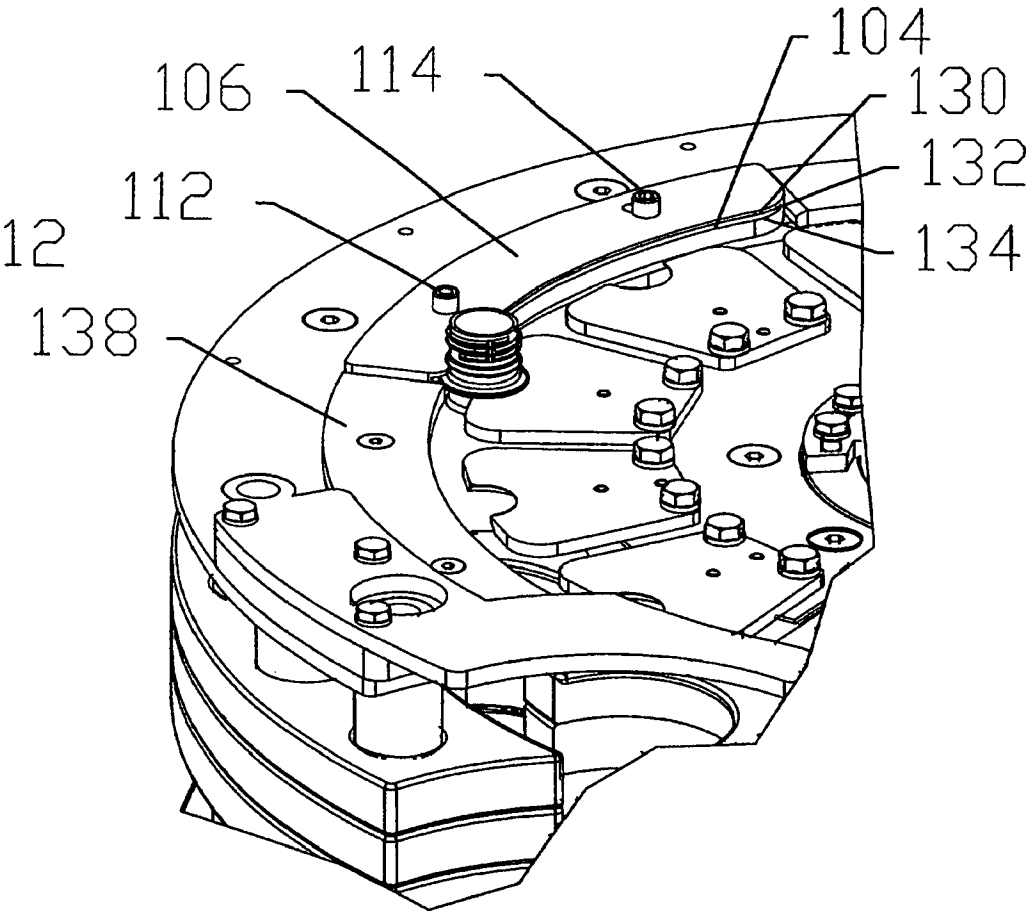
FIG. 5 is a magnified view of section A-A of the embodiment of FIG. 4.
Figure 8:
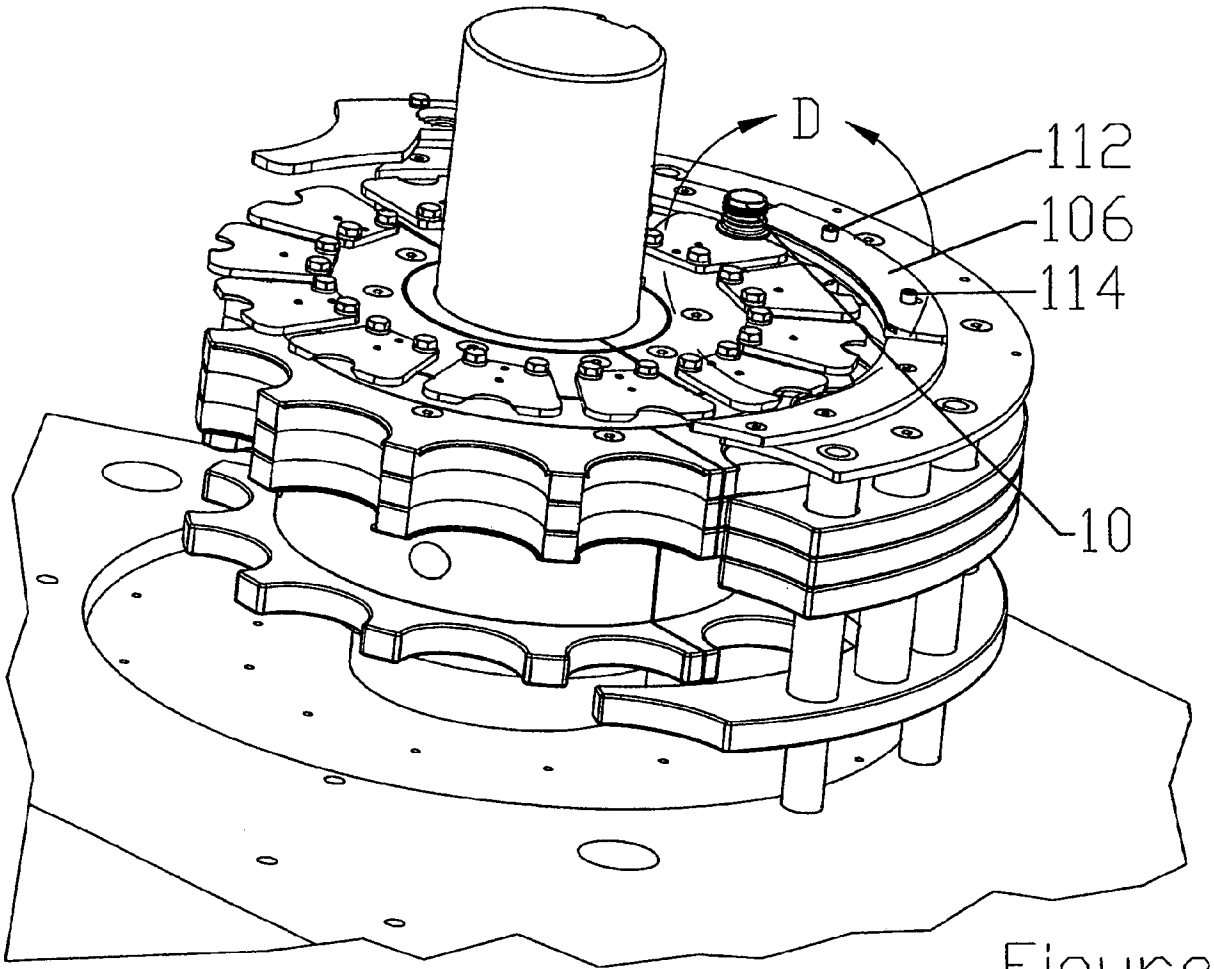
FIG. 8 is a right side perspective view of the lifter ring rotation control assembly of the present invention using a fixed position guide plate.
Figure 9:
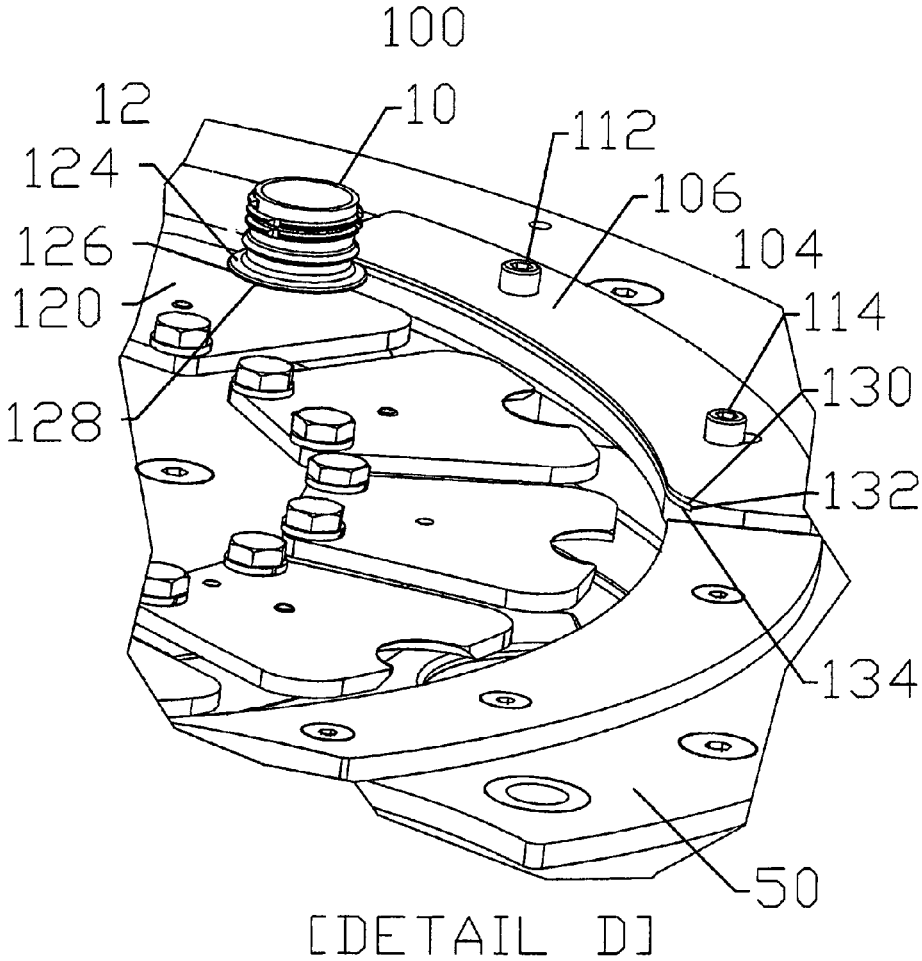
FIG. 9 is a magnified view of section B-B of the embodiment of FIG. 8.

FIGS. 4 and 5 of the embodiments show the utilization of the upper plate mounted on top of the upper stationary guide 106 with the first set screw 112 and second set screw 114 acting as two fixed pins such that no biasing spring 118 is necessary. This configuration requires a little bit more tolerance in terms of the alignment of the spin control plate 106. However, the plastic nature of the upper portion of the bottle 10 allows for slight variations in this tolerance. Also shown in FIGS. 4 and 5 of the drawings are the utilization of a lower slide plate 138 in the path of the bottle before the front of the spin control plate 106 which allows for the upper portion of the bottle 10 to slide along the upper stationary guide 40 before contacting the spin control plate 106. FIGS. 8 and 9 of the drawings show the reverse view for the non-biased spin control plate 106 mounted on top of the upper stationary guide 40.

Figure 16:
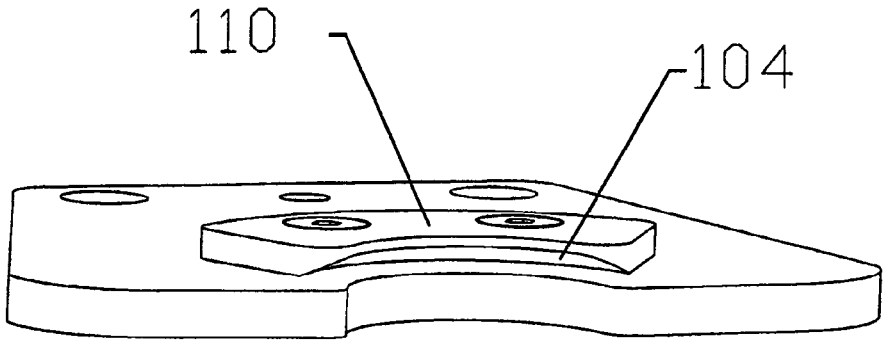
FIG. 16 shows an isometric front view of the plates used to form the groove.
Figure 17:
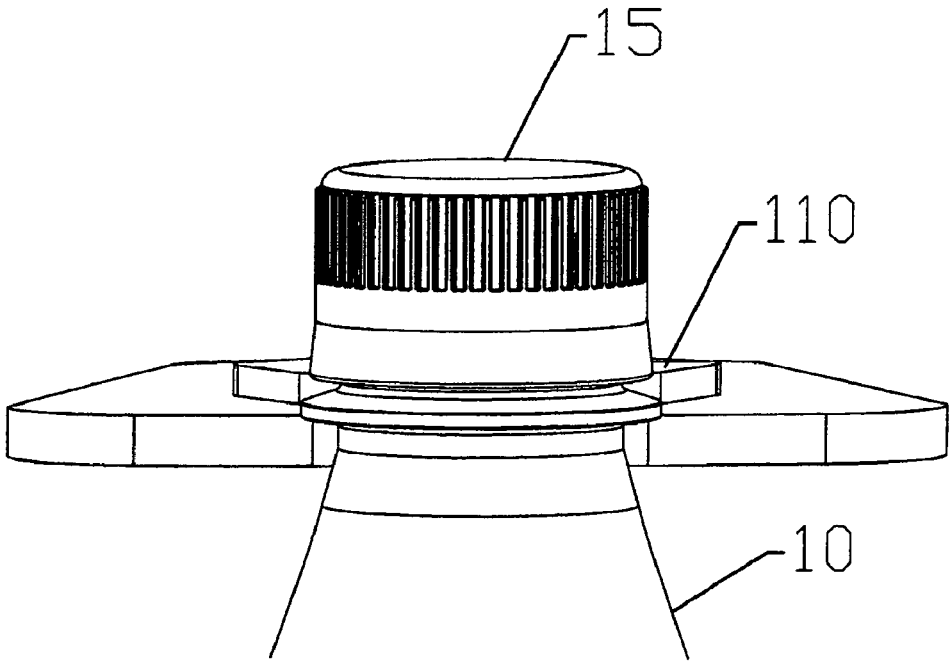
FIG. 17 shows the isometric front view of FIG. 16 with the lifter ring inserted into the groove.
Figure 18:
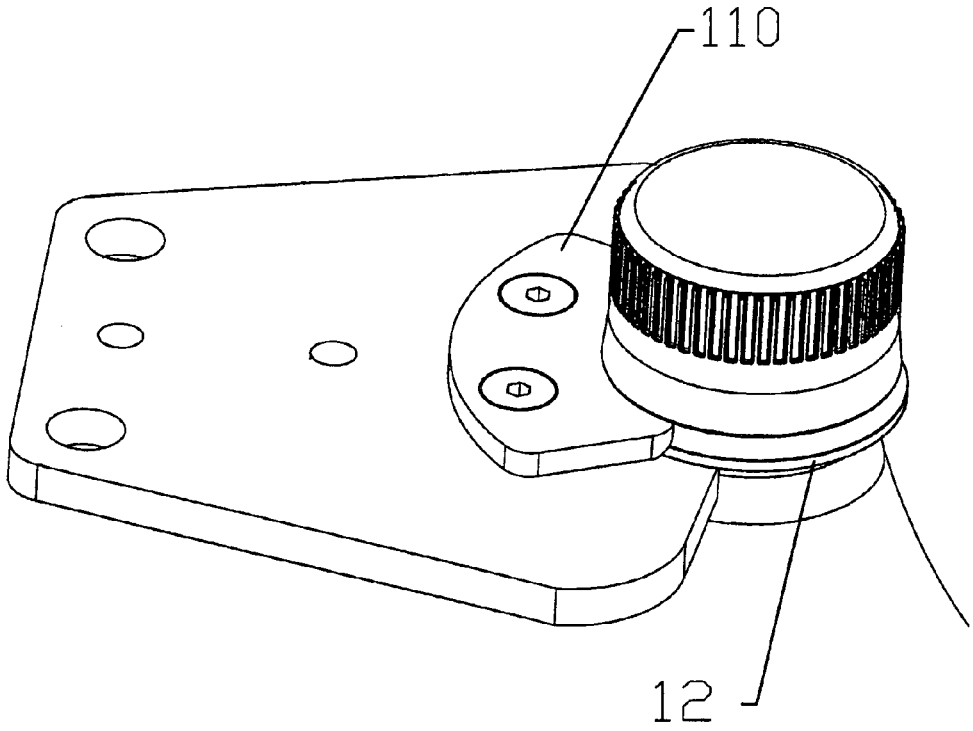
FIG. 18 shows a top isometric side view of FIG. 17 with the lifter ring inserted into the groove.

In the second embodiment shown in FIGS. 16 through 18, the present invention controls the position of the bottle 10 by providing a frictional engagement groove 104 in a rotating hold plate 110 mounted on the upper rotational receiver 60 and providing a sliding engagement with the upper stationary guide 40 such that it forms a non-rotating slide plate. Because sliding of the lifter ring is well understood, we focus on the design and implementation of the frictional control using the rotating hold plate 106 mounted on the upper rotational receiver 60. In this embodiment the bottle 10 is held in position in a frictional groove 104 in the rotating hold plate 110 such that the bottle does not spin in relation to the upper rotatable receiver 60 as the bottle rotates through the capping process. In this manner, the magnetic clutch on the capping assembly may be utilized to place the cap on top of the non-rotating bottle 10 as is well known.

In addition to the embodiments already described a third embodiment may be utilized where the bottle 10 is spun in a first direction 105 as previously described in combination with the well known counter directional rotation spin 81 of the magnetic clutch currently utilized in the prior art such that a more efficient counter spin installation of the cap onto the bottle 10 is achieved in the capping machine.

As noted in the drawings, the present invention utilizes a thin upper surface 107 above the groove 104 to allow for a tight fit between the cap 15 and upper surface of the lifter ring such that the cap 15 may come down right on top of the upper surface of the lifter ring 12. Both deformation of the cap 15 and the upper surface lifter ring 12 can provide for this clearance or alternatively a thin gap may be left from the bottom of the bottle 10 cap to the upper surface of the lifter ring 12. Thus, the present invention provides several unique advantages including: utilization of the upper, lower and side surface of the lifter ring 12 for control of bottle 10 rotation; utilization of the top side of the lifter ring 12 by itself for control of bottle 10 rotation; utilization of the side of the lifter ring 12 for control of the bottle 10 rotation; utilization of the top surface and side surface of the lifter ring 12 to control bottle 10 rotation; utilization of counter-rotation of the bottle 10 for installation of the cap; utilization of reverse rotation in combination with forward rotation of the cap in order to provide a more efficient installation of the cap onto the bottle 10; utilization of sliding spin control plates in combination with rotating cap mechanisms for installation of the cap onto the bottle 10; and other various combinations of these elements as is not known in the prior art.

Reference numbers are used as following:

bottle 10
lifter ring 12
threads 14
cap 15
bottom 16
capped bottle 17 uncapped bottle 18
base plate 20, rotating receiver 20
recess 21
plurality of sets of fingers 22
primary surface 24
table 26
rotating center unit 30
rotational direction arrow 31
upper stationary guide 40
lower stationary guide 50
upper rotating receiver 60
upper recess 62
mid-level rotating receiver 70
mid-level recess 72
capping head 80
cap head rotational direction arrow 81
cast top 140
spin control guide 100
controlling groove 104
reverse rotation 105
spin control plate 106
thin upper surface 107
supporting slide plate 108
semi-circular aperture 109
rotating hold plate 110
first set screw 112
second set screw 114
arcing movement slot 116
biasing spring 118
control block 122
upper ring surface 124
lifter ring side 126
lower ring surface 128
upper groove surface 130
side groove surface 132
lower groove surface 134
containment wedge 136
exiting lower slide plate 138
elastic frictionally engaging material 140

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

The invention claimed is:

1. A bottle control apparatus adapted to control the rotation of a bottle during the mounting of a cap onto the bottle, the bottle having a lifter ring with an upper surface, a side surface, and a bottom surface, the apparatus comprising:

a frictional engagement groove adapted to frictionally engage the lifter ring; and a lifter ring slide support adapted to slideably support bottom surface of the lifter ring;

wherein one of the frictional engagement groove and the lifter ring slide support moves in relation to the other to cause rotation of the bottle.

2. The apparatus of claim 1, wherein the frictional engagement groove is adapted to contact the upper surface of the lifter ring.

3. The apparatus of claim 2, the frictional engagement groove is adapted to contact the side surface of the lifter ring.

4. The apparatus of claim 1, wherein the frictional engagement groove is hingably mounted on a frame, the apparatus further comprising:

a biasing spring rotatably mounted to the frame and adapted to bias the groove against the lifter ring.

5. A bottle control apparatus adapted to control the rotation of a bottle during the mounting of a cap onto the bottle, the bottle having a lifter ring with an upper surface, a side surface, and a bottom surface, the apparatus comprising:

a frictional engagement groove adapted to contact the upper surface of the lifter ring; and a lifter ring slide support adapted to move in relation to the frictional engagement groove;

wherein the frictional engagement groove and lifter ring slide support are adapted to cause a rotation of the bottle.

6. A bottle control apparatus adapted to control the rotation of a bottle during the mounting of a cap onto the bottle, the bottle having a lifter ring with an upper surface, a side surface, and a bottom surface, the apparatus comprising:

a frictional engagement groove rotationally mounted to a frame, a biasing spring connected to the frame and adapted to bias the groove against the lifter ring;

a lifter ring slide support adapted to move in relation to the frictional engagement groove; and wherein the frictional engagement groove and lifter ring slide support are adapted to cause a rotation of the bottle.

* * * * *